US006216940B1

(12) United States Patent
Sugano et al.

(10) Patent No.: US 6,216,940 B1
(45) Date of Patent: Apr. 17, 2001

(54) PIPE FORMING ROLL APPARATUS AND METHOD

(75) Inventors: Koji Sugano; Masahiro Kagawa; Toshio Ohnishi; Kingo Sawada, all of Aichi; Yoshinori Sugie, Tokyo; Nobuki Tanaka, Aichi; Takaaki Toyooka, Aichi; Motoaki Itadani, Aichi; Yuji Hashimoto, Aichi; Ryoji Kusakabe; Kazuo Omura, both of Hyogo, all of (JP)

(73) Assignees: Kawasaki Steel Corporation; Kusakabe Electric & Machinery Co., Ltd., both of (JP)

( * ) Notice: Subject to any disclaimer, the term of this patent is extended or adjusted under 35 U.S.C. 154(b) by 0 days.

(21) Appl. No.: 09/506,025

(22) Filed: Feb. 17, 2000

Related U.S. Application Data

(62) Division of application No. 09/149,576, filed on Sep. 8, 1998, now Pat. No. 6,041,632.

(30) Foreign Application Priority Data

Sep. 10, 1997 (JP) ..... 9-244513
Sep. 10, 1997 (JP) ..... 9-244514

(51) Int. Cl.[7] ..... B21D 39/00; B21D 39/02; B23K 37/00

(52) U.S. Cl. ..... 228/147; 72/52; 228/17.5

(58) Field of Search ..... 228/147, 17.5; 72/52, 179, 14.4, 180, 247

(56) References Cited

U.S. PATENT DOCUMENTS

| | | | | |
|---|---|---|---|---|
| 1,078,240 | * | 11/1913 | Barbour | 72/233 |
| 3,132,547 | | 5/1964 | Doyle et al. . | |
| 4,148,206 | * | 4/1979 | Meurer et al. | 72/239 |
| 4,352,001 | * | 9/1982 | Ishibashi et al. | 219/64 |
| 4,487,044 | | 12/1984 | Fapiano . | |
| 4,530,225 | * | 7/1985 | Meurer et al. | 72/52 |
| 4,918,964 | | 4/1990 | Engel et al. . | |
| 5,060,498 | * | 10/1991 | Seto et al. | 72/164 |
| 5,301,869 | * | 4/1994 | Toyooka et al. | 228/147 |
| 5,461,896 | * | 10/1995 | Abbey, III et al. | 72/181 |
| 5,599,264 | * | 2/1997 | Hashimoto et al. | 492/39 |
| 5,673,579 | | 10/1997 | Hashimoto et al. . | |
| 5,732,874 | * | 3/1998 | Borzym et al. | 228/147 |
| 5,901,592 | | 5/1999 | Okamura . | |
| 6,041,632 | * | 9/1998 | Sugano et al. | 72/14.4 |

FOREIGN PATENT DOCUMENTS

| | | |
|---|---|---|
| 209722 | 12/1982 | (JP) . |
| 67509 | 4/1986 | (JP) . |

* cited by examiner

*Primary Examiner*—Clifford C. Shaw
*Assistant Examiner*—L. Edmondson
(74) *Attorney, Agent, or Firm*—Austin R. Miller

(57) ABSTRACT

A forming stand for continuously forming a skelp material into a pipe, by pressure of spaced-apart forming rolls supported by spaced upper and lower shafts, the forming rolls having two portions, with one portion fixedly fitted on one side of its shaft, a sleeve slidably fitted to the other end of the shaft and fixedly secured to the sleeve and slidable with respect to the shaft; a bearing box for supporting one side of the associated shaft; a bearing box supporting the other side of the associated shaft through the sleeve; upper and lower stand supporting frames for supporting both of the bearing boxes to be movable in an axial direction; and supporting columns for supporting the stand supporting frames; the pipe-forming force is continuously measured and the forming operation is adjusted such that the measured value of pipe-forming force does not exceed a predetermined pipe-forming upper limit.

1 Claim, 6 Drawing Sheets

PIPE FORMING ROLL APPARATUS AND METHOD

This application is a division of 09/149,576 Sep. 8, 1998 U.S. Pat. No. 6,041,632.

BACKGROUND OF THE INVENTION

1. Field of the Invention

The present invention broadly relates to a pipe-forming stand and continuous method for making welded steel pipes. It relates particularly to the use of pipe-forming rolls for continuously forming sheet-like steel skelp having different widths and thicknesses into steel pipe sheet material, and into welded seam tubular steel shapes.

2. Description of the Related Art

In general, there have conventionally been two types of processes for making welded steel pipes. They are forge welding and seam welding.

Forge welded pipes are formed from skelp which is continuously heated in a furnace to about 1350° C. to 1400° C. Using forming rolls, the heated skelp is formed into a tubular form having a V-shaped open portion with separate edges. After subjecting both edges of the open portion of the formed skelp to oxygen blowing, thereby further increasing the temperature of the formed skelp edges by oxidation heat, the edges of the V-shaped open portion are pressed and joined using a forge welding roll. In general, a set of two rolls each provided with holes is used for forming the pipe. When the skelp is being formed into a pipe, cooling water is at all times poured onto these rolls to prevent the generated heat from damaging them. Since forge welded steel pipes are red hot at 1350° C. or more, merely pouring cooling water on the forming rolls does not cool them down to a temperature that would prevent forge welding.

Seam welded pipes are formed from skelp continuously formed at an ordinary temperature. A forming device forms the skelp into an open tubular form having a V-shaped open portion, and both exposed edges of the open portion are heated by induction heating or by electrical resistance heating, at high frequency, to a temperature above the melting point. Then usually in successive stages, the ends of the open tubular form are pressed toward each other and are thus joined together by using a squeeze roll. The pipe-forming device ordinarily comprises a large number of separate sets of rolls (such as breakdown rolls for the first forming period, side rolls and/or cage rolls for a subsequent forming period, and fin pass rolls for yet another successive forming period). These rolls gradually curve the skelp from an open form to a closed form in order to eventually form the skelp into a hollow cylindrical pipe.

Although forge welded pipes can be produced rapidly at a speed of 300 m/min, the skelp used to form the forge welded pipes is heated to a high temperature of 1350° C. or more. This causes scales to tend to form at the edges of the skelp, causing the strength of the seam portion of the pipe to be considerably less than the strength of the base. This results in poor surface texture caused by the scales on the pipe surface. Therefore, forge welded pipes cannot be used as high grade steel pipes which must meet the requirements of surface quality and strength reliability of, for example, STK of Japanese Industrial Standards (JIS).

Seam welded pipes, which are produced at ordinary temperature, have good seam quality and surface texture, and are used as high grade steel pipes. However, large weld beads, which are formed at the seam portion by welding and pressing the skelp edges together, must be cut on-line. Accordingly, the pipe-forming speed can only be about 100 m/min at most, thereby resulting in low production speed and efficiency.

We have overcome all such problems by using a new pipe forming method, which may be called a seam welding type method for producing pipes by solid-phase pressure welding. In this method, the skelp is heated to a warm forming temperature (for example, about 600° C.) in which only a small amount of scale is generated on the skelp. Then, as in the case where seam welded pipes are produced, the skelp is formed, and the edges of the skelp are heated to a temperature below the melting point, at which temperature large beads are not formed. Thereafter, the edges of the skelp are physically pressed and joined together.

This method, however, has the following disadvantages. In this method, the skelp, whose temperature falls within the warm forming temperature, is formed using a forming device. When a forming roll contacts the hot skelp, heat is conducted to the roll shaft bearing, causing its temperature to rise excessively and causing poor forming precision. In addition, when the forming roll heats it undergoes thermal expansion and the gap between the upper and lower rolls becomes narrower, making it difficult continuously to form the skelp. To prevent this, it is necessary to subject the rolls to water cooling. Unlike the case where pipes are formed by forge welding, when external water cooling is performed, the cooling water, which is poured onto the skelp, reduces the temperature of the skelp. This makes it difficult to maintain the temperature of the edge portions of the skelp within the temperature range that allows solid-phase pressure welding, just below the melting point, when heating at a high frequency is being performed.

The need to produce a large variety of different steel pipe products has caused a strong demand for efficient production when the volume of production of a particular tubular product is relatively low. To respond to this demand, it is essential to achieve continuous production of pipes with skelp materials of different widths and/or thicknesses. This requires a forming device which, in a breakdown mill, allows the distance between the upper and lower rolls to be changed, and which also allows changing the distance between the divided left-hand and right-hand portions of each of the horizontal upper and lower rolls.

In order to change the distance between the upper and lower horizontal rolls, it is possible to use a mechanism for raising and lowering bearing boxes which support a roll shaft.

In order to change the distance between the left-hand and right-hand portions of a divided roll, a mechanism may be used which uses a hydraulic arbor, capable of increasing and decreasing the diameter thereof, as a shaft. The diameter of the shaft is decreased in order to allow the divided roll to move freely in the axial direction for positioning. Then, the diameter of the shaft is increased in order to lock the divided roll. However, the hydraulic arbor has a hydraulic mechanism built therein, making it difficult additionally to dispose a water cooling mechanism therein.

Accordingly, when the volume of production is relative low and a wide variety of tubular products are to be made, the seam welding method of producing pipes by solid phase pressure welding cannot be used along with a conventional forming stand using rolls.

SUMMARY OF THE INVENTION

We have created a forming stand using rolls (more specifically an edge bend roll stand), which comprises upper and lower forming rolls supported by a pair of horizontally disposed upper and lower shafts. Each forming roll is divided into at least two parts: a left-hand portion and a right-hand portion. One of the left- and right-hand portions of each forming roll is fixedly fitted to its associated shaft, while the other is slidably fitted to the other end of its associated shaft. One end of each shaft is supported by an associated bearing box, whereas the other end is supported by another associated bearing box through an associated sleeve that is fitted so as to be movable in an axial direction. The sleeves and the other of the forming roll portions are fixedly coupled together, and the bearing boxes are supported at supporting frames of the stand so as to be adjustable back and forth on the shaft.

Desirably a water cooling path is provided that extends from the interior of each shaft to the interior of the roll stand, in the area between spaced sets of forming rolls, for skelp cooling and roll cooling purposes.

Further desirably a motor may be connected for raising and lowering the upper roll. It may be combined with a load cell disposed at a supporting portion of the upper roll, for controlling the movement of the motor in response to the forming force being applied to the skelp at any given moment. With the load cell continuously outputting forming force value, and a roll gap controller motor for adjusting the height of the upper roll by comparing the output value of the load cell with a programmed upper limit, the motor is controlled so that the forming force does not exceed an upper predetermined limit.

This invention further encompasses a method of continuously forming a skelp material, using a stand having forming rolls supported by a pair of generally horizontally disposed upper and lower shafts. The method comprises the steps of continuously measuring the forming force imposed by and upon the bending skelp and continuously forming the skelp material while adjusting the distance between the rolls such that the measured value does not exceed a designated upper limit.

Further details of the present invention will become apparent from the following description of the preferred embodiments, with reference to the attached drawings.

According to the present invention, a forming stand with rolls, which includes a roll width changing mechanism, and, when necessary, an interior water cooling mechanism, is realized. Therefore, a seam welding type method for producing pipes by solid-phase pressure welding, which produces steel pipes of excellent seam quality and surface texture with high efficiency, can be used advantageously even in the case where the volume of production is relatively low and a wide variety of different tubular products are to be produced by the same equipment.

In addition, according to the present invention, it is possible to maintain the distance between the upper and lower rolls at a particular desired value by offsetting the roll temperatures. Therefore, even when the forming rolls undergo thermal expansion at the time the skelp is being subjected to warm forming by the rolls, when performing a seam welding type method for producing pipes by solid-phase pressure welding, the skelp material can be formed continuously. This makes it possible to produce steel pipes of excellent seam quality and surface texture, with great efficiency.

DESCRIPTION OF THE PREFERRED EMBODIMENTS

Figure 5B:
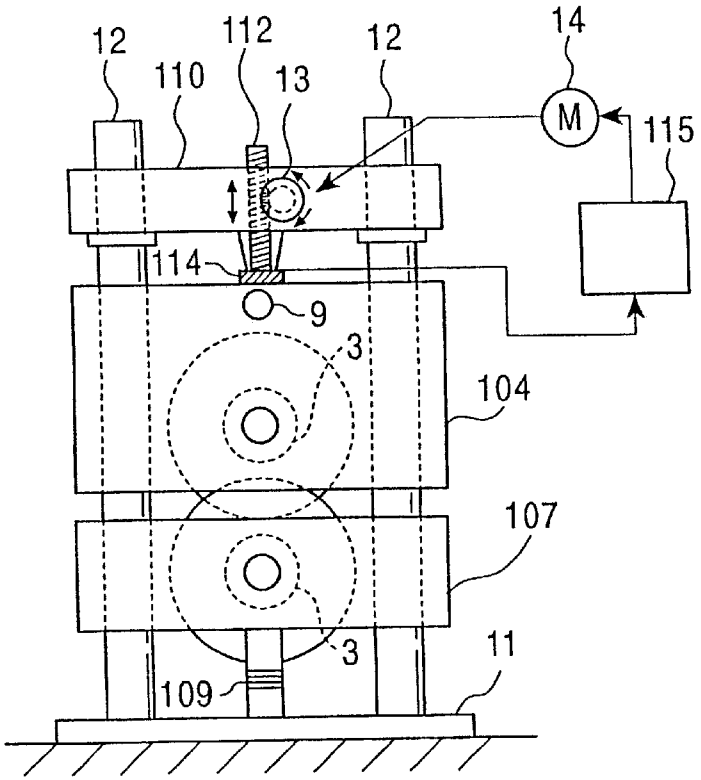
FIGS. 5A and 5B are a schematic front view and an illustration taken in the direction of the arrows along line VB—VB of another embodiment of the forming stand using rolls in accordance with the present invention.
Figure 5A:
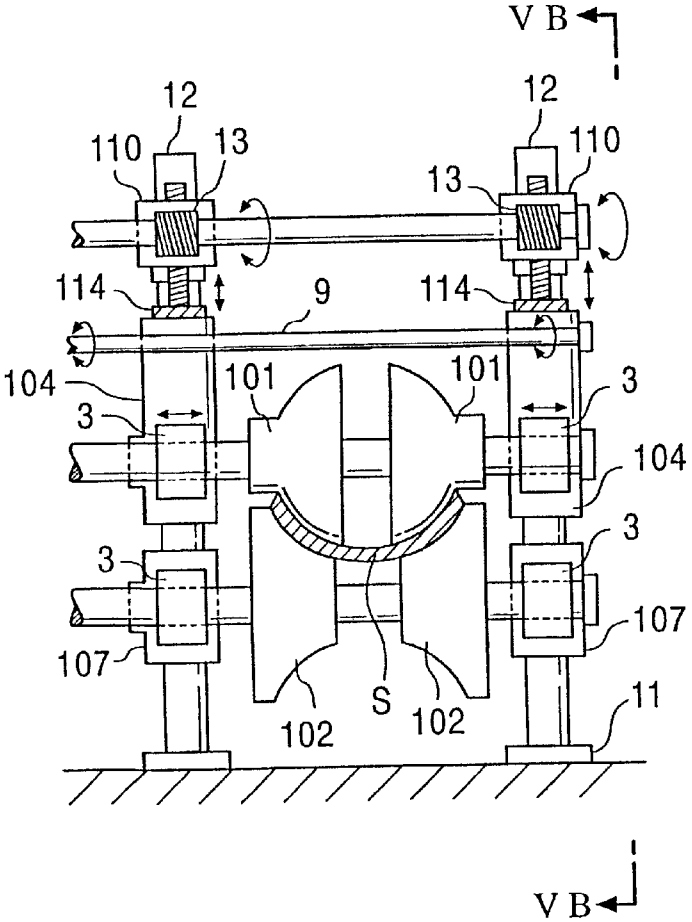

In accordance with the present invention, a pair of horizontally disposed upper and lower forming rolls are provided, each of which is divided into a left portion and a right portion, with the left and right portions of each forming roll supported by an associated shaft as shown in FIGS. 5A and 5B. One of the forming roll portions of each forming roll is fixed to one end of the associated shaft. The other forming roll portion of each forming roll is slidably adjustably fitted to the other end of the associated shaft. One end of each shaft is supported by one of the associated bearing boxes, while the other end of each shaft is supported by the other of the bearing boxes through an associated sleeve, which is movable in an axial direction. The other of the forming roll portions and the associated sleeves are fixedly coupled together, and the bearing boxes are supported by associated supporting frames of the stand, so they are movable in an axial direction. This makes it possible to adjust the distance between the left and right forming portions of each forming roll on the run by moving the left and right bearing boxes along the shaft axis.

When paths, whose inlet and outlet are formed at one end of the aforementioned shafts, are provided for causing cooling water to flow therethrough from the interior of the corresponding shafts to the interior of the forming roll portions of the corresponding forming rolls, the interiors of the forming rolls can be subjected to water-cooling, when necessary.

According to the present invention, a forming stand using rolls incorporating both a roll width varying mechanism and an interior water cooling mechanism is realized. Therefore, the seam welding type method for producing pipes by solid-phase pressure welding, which allows steel pipes with excellent seam quality and surface texture to be formed, can be used when the volume of production is relatively low and there are a wide variety of products to be made.

We turn now to another aspect of the forming stand and rolls.

Conventionally, continuous formation of skelp at a high temperature causes the forming rolls to become hotter, and to expand. This narrows the gap between the upper and lower rolls, causing them to exert an increased force on the skelp from above and below the skelp, and eventually to prevent passage of the skelp between them.

According to the present invention, this problem is overcome in the following way. A load cell is provided at the support of the upper roll in order to measure continuously the forming force or the reaction force of the skelp when forces are being exerted on it from above and below to bend it into a tubular shape. The position of the height of the upper roll is adjusted at all times so that the value of the forming force does not exceed a predetermined value, while the skelp is being formed into a pipe. Thus, the predetermined value can be set to a suitable value, such as a value close to a known upper limit, which falls within the range of values allowing skelp forming. When, for example, the actually measured value of the forming force is expected to exceed the predetermined value, this is sensed and the position of the upper roll is controlled in response to the sensor output by moving the upper roll upwardly and thereby decreasing the forming force to or toward an initial preset value. When this is done, the forming operation, which would be undesirably interrupted if the upper and lower rolls were to prevent passage of the skelp, is not interrupted, causing skelp forming to be continuously and successfully performed. In this case, it is often not necessary to subject the rolls to water cooling.

FIGS. 5A and 5B illustrate important features of the invention. They are a schematic front view and an illustration taken along the lines and arrows VB—VB in FIG. 5A. The structure of the forming stand includes a horizontally disposed upper roll 101 and lower roll 102, used to form a skelp material S into a pipe. They comprise a left-hand portion and a right-hand portion, which are separately movable axially under influence of the movement of left-hand and right-hand bearing boxes 3. The bearing boxes 3, 3 are oppositely screwed into associated spaced-apart supporting frames 104, and are rotated in synchronism with each other using a width changing gear rod 9 in order to change, the distance between the left-hand and right-hand portions of the upper roll 101. Left-hand and right-hand bearing boxes 3 at the lower roll 102 are supported by spaced-apart lower supporting frames 107 so they are movable back and forth in the axial direction. This can be done continuously without interrupting production.

The upper supporting frames 104 and the lower supporting frames 107 are supported by supporting columns 12 that are vertically disposed on their bases 11 so that they can be adjusted slidably up and down while running. Above the upper supporting frames 104 is provided a beam frame 110 having a worm gear 13, and fixed to the supporting columns 12. The upper supporting frames 104 each has a raising-and-lowering gear rod 112 that engages its associated worm gear 13. The engagement of the gear rods 112 and the worm gears 13 allows the upper supporting frames 104 to be supported in such a way that their heights can be adjusted. The worm gears 13 are rotated by driving an alternating current servo motor. It is to be noted that the lower supporting frames 107 are supported such that their heights can be adjusted by a jack 109 fixed to the base 11.

In FIGS. 5A and 5B, forming force detecting load cells 114 are disposed at the upper supporting frames 104 which support the upper roll 101. This inputs the output of the load cells 104 continuously into a roll gap controller 115 (FIG. 5B). The roll gap controller 115 electronically compares the load cell output with a predetermined upper limit in order to control the rotation of the AC servo motor 14 at all indicated times, such that the load cell output does not exceed the upper limit for adjustment of the height of the upper roll 101.

Figure 6:
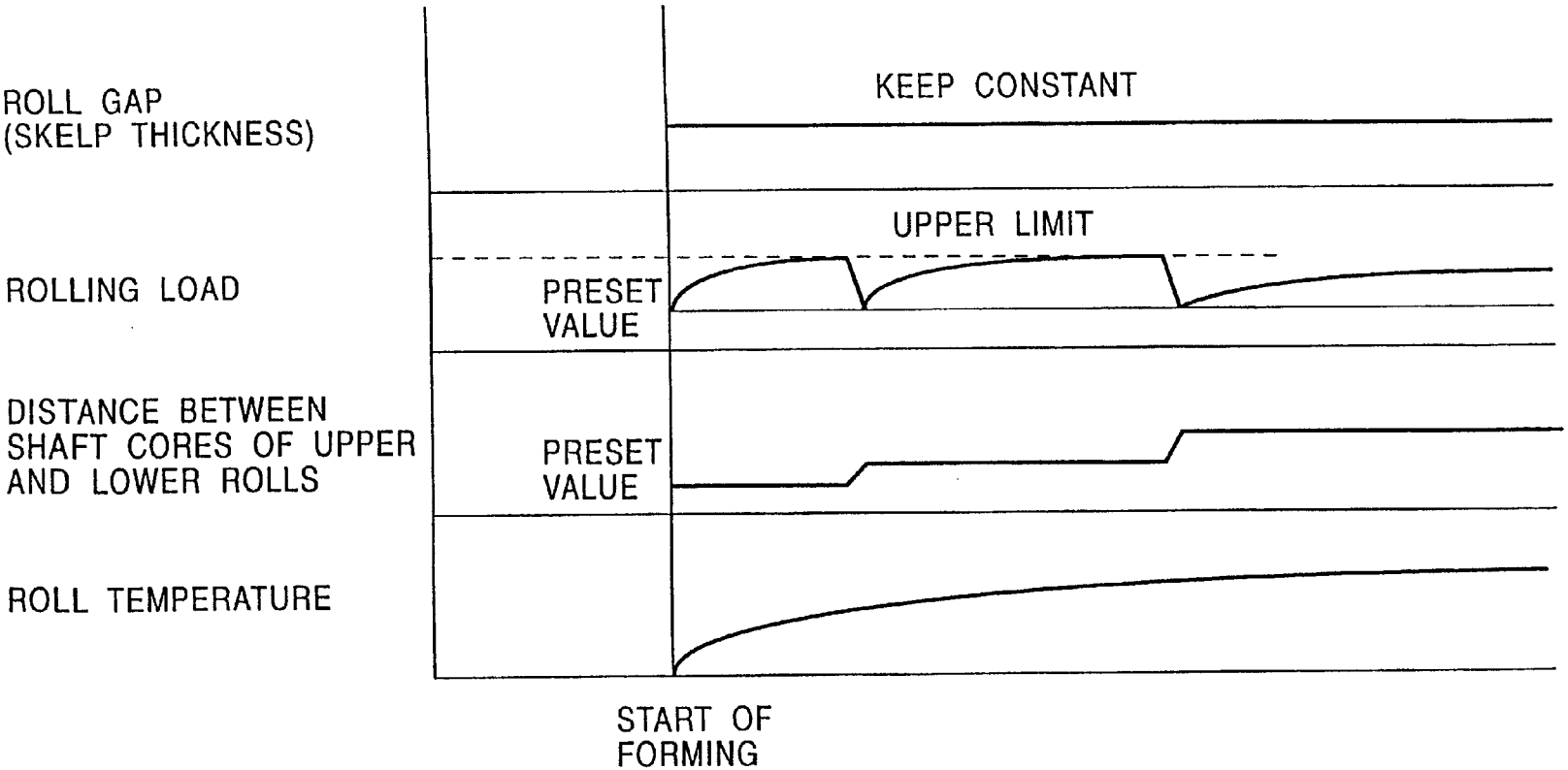
FIG. 6 is a timing chart in accordance with the present invention.

FIG. 6 is a timing chart indicating control movements that can be made in the present invention. When the skelp is heated to a temperature of about 600° C. before it is formed, the upper and lower rolls undergo thermal expansion as the rolls gather heat with the passage of time. The resulting gradual increase of the reaction force of the skelp causes the load cell output value to increase gradually from the preset value. Just before the load cell output value exceeds the preset set value, the AC servo motor 14 is rotated in a predetermined amount to increase the height of the upper roll 101 (FIG. 5A), that is the axial distance between the upper roll 101 and the lower roll 102, causing the load cell output value to be reset to the preset value. This allows the size of the roll gap to be controlled to a certain value in accordance with the skelp thickness, thereby preventing interruption of the forming operation. Such interruption could, in the absence of this invention, be caused when the rolls do not allow the skelp to pass therethrough.

The forming force upper limit of a usable preset value depends on such factors as steel type, skelp thickness, and forming amount (outer diameter of pipe). Therefore, preliminary experiments and analyses of operational results may be performed to obtain, in a particular case, a knowledge of how the upper limit varies with such factors. The proper upper limit value should be selected based on this knowledge.

Figure 1:
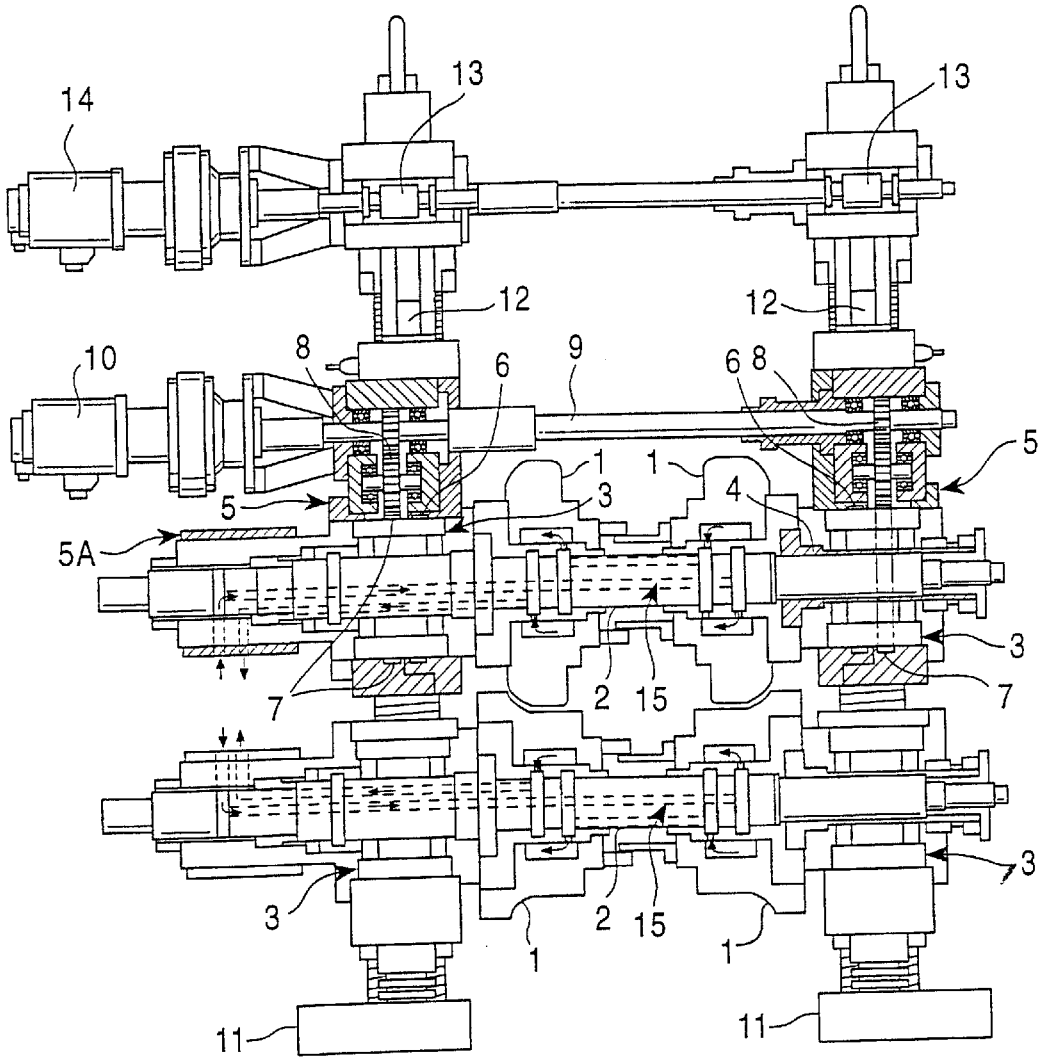
FIG. 1 is a front sectional view of an embodiment of a forming stand in accordance with the present invention.
Figure 2A:
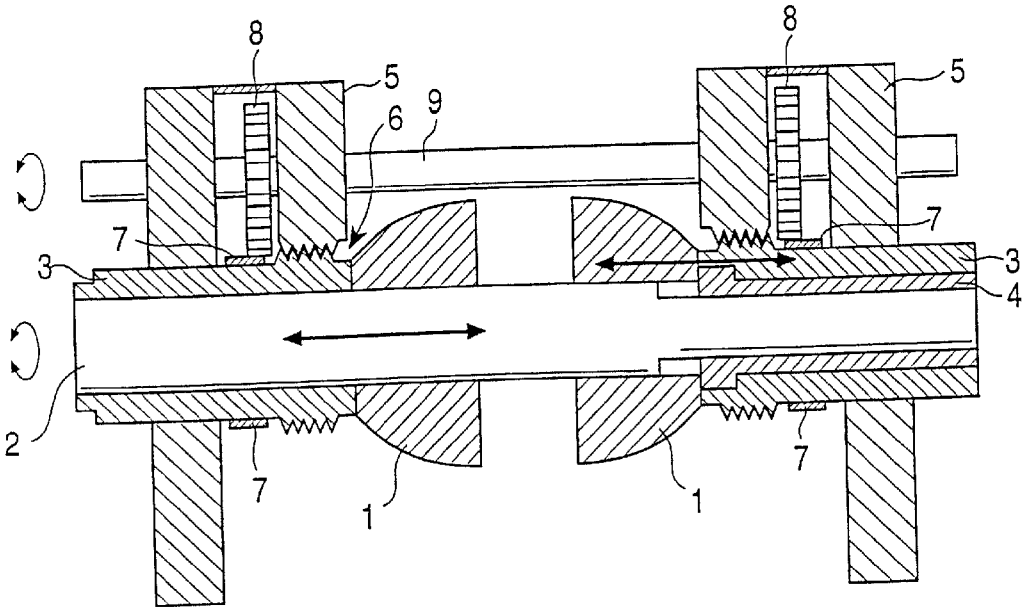
FIG. 2A and 2B are schematic views showing the details of the forming stand of FIG. 1.
Figure 2B:
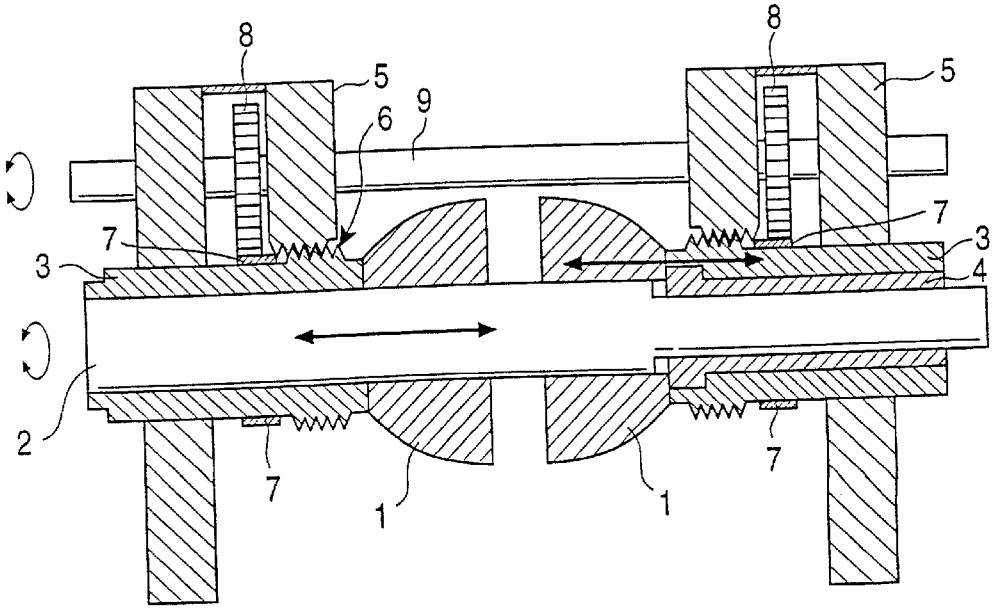

Turning now to FIGS. 1 and 2 of the drawings, FIG. 1 is a front sectional view showing details of a forming stand of the present invention, while FIG. 2 illustrates details of the forming stand of FIG. 1. A horizontally disposed upper roll 1 and lower roll 1 is each divided into a left-hand portion and a right-hand portion. The left-hand and right-hand portion of each roll 1 is supported by an associated shaft. The left-hand portion of each forming roll 1 is fixedly fitted to the associated shaft 2, while the right-hand portion of each forming roll 1 is slidably fitted to the associated shaft 2. The left-hand end portion of each shaft 2 is directly supported by a left bearing box 3 associated thereto, whereas the right-hand end side of each shaft 2 has fitted thereto, through splines, an associated sleeve 4 which is movable in an axial direction. The sleeves 4 and the associated right-hand portions of the forming rolls 1 are fixedly coupled together.

The left-hand and right-hand bearing boxes 3 are supported, so as to be movable in an axial direction, by supporting frames 5 disposed on the left-hand and right-hand sides of the stand. Although in FIG. 1 only the upper roll 1 is shown as having supporting structures for supporting the bearing boxes 3 to allow them to move in an axial direction, such supporting structures may also be provided at the lower roll. In the supporting structures, the bearing boxes 3 are secured to their associated supporting frames 5 by associated threaded portions 6, and toothed portions 7, at the outer periphery of their associated bearing boxes 3, and the teeth of gears 8, at their associated supporting frames 5, engage each other. Turning any one of the bearing shafts 3 around its associated shaft 2 by turning the associated gear 8 causes the associated bearing box 3 to move along the axial direction. Forward and backward rotation of any one of the gears 8 causes forward and backward movement, respectively, of the associated bearing box 3.

When any one of the left-hand bearing boxes moves in the axial direction, the associated left-hand portion of the forming roll 1, fixedly fitted to the associated shaft 2, moves in the axial direction. When any one of the right-hand bearing boxes moves in the axial direction, the associated sleeve 4 moves. At the same time that the associated sleeve 4 moves, the associated right-hand portion of the forming roll 1, slidably fitted to its associated shaft 2 and fixedly coupled to its associated sleeve 4, moves in the axial direction.

In this example, the left-hand and right-hand threaded portions 6 are threaded in opposite directions. The left-hand and right-hand bearing boxes 3 can be moved toward or way from each other by rotating their associated left-hand and right-hand gears 8 in the same direction, in the forward or backward direction. Any one of the gears 8 is rotated by driving a roll width adjusting motor 10 (FIG. 1) having teeth that engage the teeth of the gear 8.

Therefore, by turning the roll width adjusting motor 10 in forward or backward direction, the left-hand and right-hand forming roll portions of each forming roll 1 can be moved toward or away from each other.

The distance between the rolls 1 in the height direction is adjusted as follows. Each supporting frame 5 is screwed into its associated supporting column 12 (FIG. 1) that is vertically formed on its associated base 11. By turning the screwed portions, through their associated worm gears 13, by a motor 14 for raising and lowering the rolls 1, the upper forming roll 1 is raised or lowered with the supporting frames 5.

Accordingly, the shafts of FIGS. 1 and 2 do not have a complicated mechanism. Each shaft 2 is fixedly fitted to the left-hand portion of its associated forming roll 1 and slidably fitted to the right-hand portion of its associated roll 1, with the right-hand end of each shaft being supported by its associated supporting frame 5 through its associated bearing box 3. Therefore, in order to circulate cooling water between the interior and exterior of each forming roll 1 through the interior of its associated shaft 2, a water path having simple structure can be easily formed and maintained.

In FIGS. 1 and 2, water paths 15 are formed for causing cooling water to pass therethrough. Each of the water paths 15 has an inlet and an outlet for the cooling water. An inlet and outlet of each water path 15 is provided at an extension portion 5A at the left-hand supporting frame at the left end of their associated shafts that are connected to a shaft drive motor (not shown). Each water path 15 is formed such that it causes cooling water to flow successively from its inlet, through the wall of its left-hand supporting wall 5, through the wall of its associated left-hand bearing box 3, and into its associated shaft 2. Then, each water path 15 causes the cooling water to flow successively through its associated shaft 2 toward the right, through the right-hand portion of its associated forming roll 1, and through the left-hand portion of its associated roll 1 via the interior of its associated shaft 2. Afterward, each water path 15 causes the cooling water to flow successively through its associated shaft 2 toward the left, through the wall of its associated left-hand bearing box 5, through the wall of the left-hand supporting frame 5, and out through its associated outlet.

Each supporting frame 5 and its associated bearing box 3, each left-hand bearing box 3 and the left end portion of its associated shaft 2, and each shaft 2 and the right-hand portion of its associated roll 1 undergo mutual movement, such as a sliding movement or a rotational movement, at their respective interfaces.

Figure 3A:
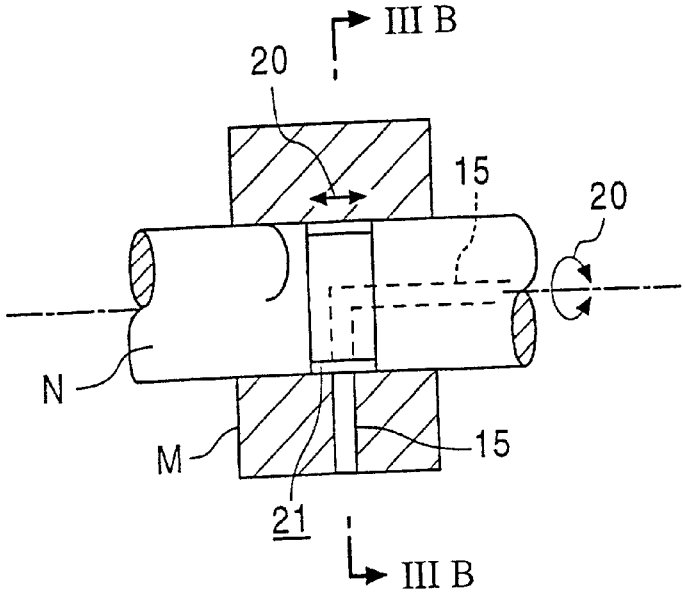
FIG. 3A and 3B illustrate a form of the forming stand in which a water path is formed between two members that move mutually with respect to each other.
Figure 3B:
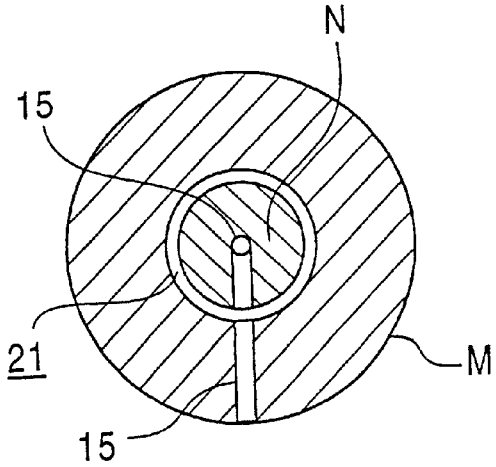

It is important to form the water paths 15 between each of the aforementioned two component parts so that they cross these interfaces. Accordingly, in order to prevent the cooling water from being blocked in each of the water paths 15, a water path connecting portion 21 may, for example, be formed, as shown in FIG. 3. The water path connecting portion 21 is larger than the distance through which the mutual movement takes place (the range of mutual movement being indicated by the double-headed solid arrow 20), and is provided at one or both sides of members M and N that undergo mutual movement at both sides of the interface, with the water path connecting portion 21 being formed at member N in FIG. 3.

Figure 4:
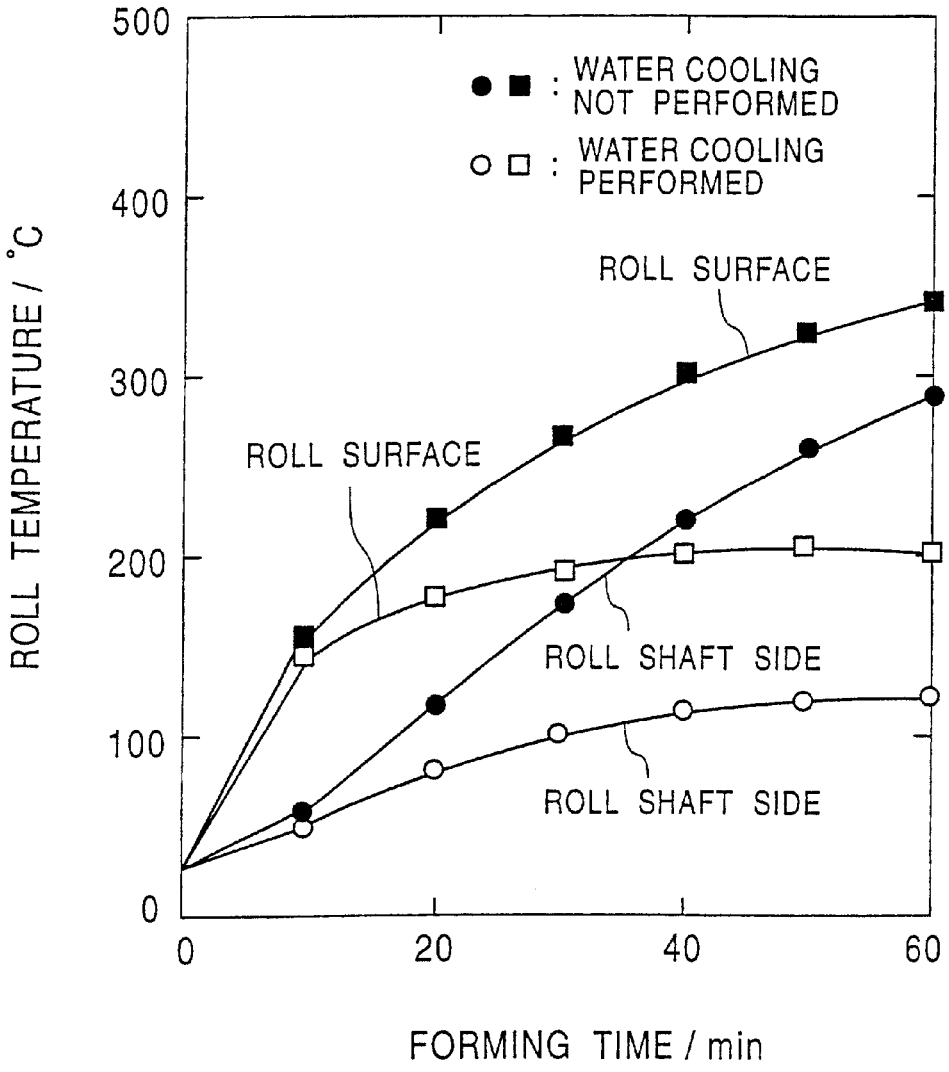
FIG. 4 is a graph which shows that a temperature increase of a roll is reduced when the interior of the forming stand is cooled using water.

FIG. 4 of the drawings shows actual measurements taken of successive runs using the apparatus of FIGS. 1–3. Skelp, which was heated to 600° C. and had a thickness of 4.5 mm and a width of 270 mm, was continuously formed into a curved shape using the forming stand with rolls, as shown in FIG. 1. Temperatures were measured at a surface of the forming rolls 1 and at portions of the roll shafts, when the interior of the rolls 1 was cooled by causing cooling water to flow through the water paths 15 at 5 liters/min, and alternatively when water cooling was not performed on the rolls 1. In measuring the temperatures, a contact thermometer was pressed against the left-hand and right-hand portions of the surfaces of the forming rolls 1, and the portions of the shafts 2 near the joints of the rolls 1. Of the temperatures measured at the roll surfaces and at the roll shaft sides, the higher values are stated in the graph FIG. 4.

As shown in FIG. 4, the temperatures of the roll surface, when the interior of the roll was cooled using water, were reduced to about ½ the temperatures of the roll surface when the interior of the roll was not cooled using water. The temperature at the roll shaft when water cooling was performed was reduced to about 120° C., which is much lower than 200° C., which is the upper limit allowing the use of a bearing. Therefore, it is clear that the present invention has provided significant production and product advantages.

In this specification and in the claims the word "skelp" is intended to refer broadly to any form of narrow coiled sheet metal, usually made from slab by heating and by a multiplicity of top and bottom rolls and edging rolls, usually with close control of sheet width and capable of being taken from coil storage, peeled from the coil and fed continuously to the pipe or pipe-making process. For purposes of this invention, no specific limitation is intended in referring to the starting material as skelp.

What is claimed is:

1. A method of producing a seam welded pipe by continuously forming a skelp material into a steel tubular shape, comprising the steps of:

forming the edge of the material by bending by a forming roll stand comprising upper and lower forming rolls supported by substantially horizontally disposed upper and lower shafts, said forming rolls having space between them to provide a passage way for moving skelp between them for formation into pipe, wherein a. each said forming roll has a first and second spaced-apart portions with adjustment space between them, wherein said first portion is fixedly fitted to one portion of said shaft associated thereto and said second portion of said forming roll is slidably fitted on said shaft for rotational and axial displacement thereon; and wherein b. a sleeve is fitted slidably to the other end of said associated shaft and to said second portion of said forming roll;

c. a first bearing box is positioned for supporting one end of said associated shaft;

d. a spaced-apart second bearing box is positioned for supporting the other end side of said associated shaft through said sleeve;

e. upper and lower stand supporting frames are connected for supporting both of said bearing boxes in a manner for axial and rotational movement;

f. supporting columns are connected for supporting said stand supporting frames;

g. wherein each of said first and second bearing boxes are adapted for simultaneous and symmetrical axial displacement for adjustment of each of said first and second roll portions with respect to each other; and by cooling in h. a cooling water path in either one or more of said shafts and either one or more of said rolls, and the further steps of:

forming said skelp material with bent edges into a substantially tubular shape;

heating said edges of said formed skelp material to a temperature below the melting point of said skelp material; and pressing and welding the resulting heated edges together.

* * * * *